US009935393B2

(12) United States Patent
Tada et al.

(10) Patent No.: US 9,935,393 B2
(45) Date of Patent: Apr. 3, 2018

(54) WATERPROOF CONNECTOR

(71) Applicant: Japan Aviation Electronics Industry, Limited, Tokyo (JP)

(72) Inventors: Takashi Tada, Tokyo (JP); Katsumi Arai, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/474,555

(22) Filed: Mar. 30, 2017

(65) Prior Publication Data

US 2018/0054020 A1 Feb. 22, 2018

Related U.S. Application Data

(63) Continuation of application No. PCT/JP2015/081349, filed on Nov. 6, 2015.

(30) Foreign Application Priority Data

Nov. 14, 2014 (JP) ..... 2014-231767

(51) Int. Cl.
*H01R 13/52* (2006.01)
*H01R 13/424* (2006.01)
*H01R 13/6581* (2011.01)

(52) U.S. Cl.
CPC ..... *H01R 13/5213* (2013.01); *H01R 13/424* (2013.01); *H01R 13/5216* (2013.01); *H01R 13/6581* (2013.01); *H01R 2201/00* (2013.01)

(58) Field of Classification Search
CPC ..... H01R 13/521; H01R 13/5213; H01R 13/5202
See application file for complete search history.

(56) References Cited

U.S. PATENT DOCUMENTS 8,801,463 B2 * 8/2014 Tan ..... H01R 13/5202 439/607.04
9,112,299 B2 * 8/2015 Lu ..... H01R 13/5227
9,385,484 B2 * 7/2016 Chen ..... H01R 13/6594
(Continued)

FOREIGN PATENT DOCUMENTS

CN 203871583 U 10/2014
JP 7-201395 A 8/1995
(Continued)

*Primary Examiner* — Ross Gushi
(74) *Attorney, Agent, or Firm* — Muncy, Geissler, Olds & Lowe, P.C.

(57) ABSTRACT

A waterproof connector including one or more contacts each having a contact-side waterproof shaped section formed around a surface of a contact-side fixed section, a shell having a fitted section with a pair of flat shell outer surfaces and a shell-side waterproof shaped section formed around a surface of a shell-side fixed section, a housing holding the one or more contacts and the shell, and a seamless waterproof member disposed around a periphery of the housing, the shell-side fixed section being positioned closer to a fitting axis between the waterproof connector and a counter connector than the shell outer surfaces of the fitted section is when viewed in a direction of the fitting axis, the shell-side waterproof shaped section, the contact-side waterproof shaped section and the waterproof member being disposed to overlap each other at a position in the direction of the fitting axis.

14 Claims, 7 Drawing Sheets

(56) References Cited

U.S. PATENT DOCUMENTS

| | | | | |
|---|---|---|---|---|
| 9,444,177 | B2 * | 9/2016 | Tsai | H01R 13/5202 |
| 9,525,236 | B2 * | 12/2016 | Lee | H01R 13/5202 |
| 9,553,410 | B2 * | 1/2017 | Zhao | H01R 13/6581 |
| 9,564,705 | B2 * | 2/2017 | Arai | H01R 13/405 |
| 9,608,359 | B2 * | 3/2017 | Arai | H01R 12/716 |
| 9,627,796 | B2 * | 4/2017 | Tsai | H01R 13/5202 |
| 9,634,425 | B1 * | 4/2017 | Hsu | H01R 13/5202 |
| 9,660,373 | B2 * | 5/2017 | Tsai | H01R 13/5202 |
| 9,685,728 | B2 * | 6/2017 | Yao | H01R 13/521 |
| 9,685,740 | B1 * | 6/2017 | Hsu | H01R 13/6585 |
| 9,711,910 | B2 * | 7/2017 | Zhao | H01R 13/5202 |
| 9,742,098 | B2 * | 8/2017 | Zhao | H01R 13/5202 |
| 9,755,348 | B2 * | 9/2017 | Guo | H01R 12/7064 |
| 9,755,353 | B2 * | 9/2017 | Tsai | H01R 13/5219 |
| 9,761,988 | B1 * | 9/2017 | Lin | H01R 13/5216 |
| 9,768,544 | B2 * | 9/2017 | Du | H01R 13/521 |
| 9,768,545 | B1 * | 9/2017 | Hsu | H01R 13/521 |
| 9,774,130 | B2 * | 9/2017 | Zhao | H01R 4/02 |
| 9,793,644 | B2 * | 10/2017 | Fujii | H01R 13/5202 |
| 9,812,809 | B2 * | 11/2017 | Arai | H01R 13/5213 |
| 9,812,810 | B2 * | 11/2017 | Arai | H01R 13/523 |
| 2009/0191927 | A1 | 7/2009 | Hong | |
| 2015/0325944 | A1 * | 11/2015 | Chien | H01R 13/5202 439/271 |
| 2015/0333435 | A1 | 11/2015 | Arai et al. | |
| 2016/0020549 | A1 * | 1/2016 | Chen | H01R 13/5219 439/78 |
| 2016/0093974 | A1 * | 3/2016 | Lai | H01R 13/5202 439/736 |
| 2017/0162975 | A1 * | 6/2017 | Tsai | H01R 13/5202 |
| 2017/0187140 | A1 * | 6/2017 | Tsai | H01R 13/521 |
| 2017/0194735 | A1 * | 7/2017 | Arai | H01R 13/5202 |
| 2017/0207570 | A1 * | 7/2017 | Guo | H01R 12/722 |
| 2017/0250495 | A1 * | 8/2017 | Yudate | H01R 13/5202 |
| 2017/0256881 | A1 * | 9/2017 | Lambie | H01R 13/5219 |
| 2017/0279234 | A1 * | 9/2017 | Tsai | H01R 24/60 |
| 2017/0279235 | A1 * | 9/2017 | Tada | H01R 24/60 |
| 2017/0317443 | A1 * | 11/2017 | Wang | H01R 13/405 |
| 2017/0324186 | A1 * | 11/2017 | Zhu | H01R 13/521 |
| 2017/0324187 | A1 * | 11/2017 | Zhu | H01R 13/5202 |
| 2017/0324188 | A1 * | 11/2017 | Guo | H01R 13/5219 |
| 2017/0338585 | A1 * | 11/2017 | Wang | H01R 13/5202 |
| 2017/0338586 | A1 * | 11/2017 | Wang | H01R 13/5202 |
| 2017/0346213 | A1 * | 11/2017 | Toda | H01R 13/504 |
| 2017/0346216 | A1 * | 11/2017 | Tada | H01R 13/5202 |

FOREIGN PATENT DOCUMENTS

| | | | |
|---|---|---|---|
| JP | 2003197302 | A | 7/2003 |
| JP | 2009176734 | A | 8/2009 |
| JP | 2013-054844 | A | 3/2013 |
| JP | 5433776 | B1 | 3/2014 |

* cited by examiner

WATERPROOF CONNECTOR

BACKGROUND OF THE INVENTION

The present invention relates to a waterproof connector, particularly to a waterproof connector having one or more contacts and a shell.

In recent years, portable electronic devices have been widely used. Such electronic devices are made thinner and required to have an excellent waterproof function. Accordingly, connectors for use in electronic devices are also required to be thin and have waterproof properties.

In addition, to prevent transmitted electric signals from being affected by electromagnetic waves from outside, the development of connectors shielded against electromagnetic waves is in progress.

Such a connector having both waterproof properties and electromagnetic wave shielding properties is disclosed in, for instance, JP 2013-54844 A. This connector has the configuration in which a housing 1 made of an insulating resin is molded integrally with a cylindrical shell 2 made of metal and contacts 3 for use in establishing conductive connection, as shown in FIG. 17. A counter connector accommodating section 4 for accommodating a counter connector is formed in the shell 2, and each of the contacts 3 is formed at its one end with a contact section 3A exposed in the counter connector accommodating section 4 to come into contact with a contact of the counter connector and at its other end with a board connecting section 3B projecting from the rear of the housing 1 to be connected to a board 5.

A waterproof member 6 made of rubber is molded against the housing 1 so as to cover the outer peripheral portion of the housing 1 and the board connecting sections 3B of the contacts 3 connected to the board 5. The outer peripheral portions of the shell 2 and the waterproof member 6 are covered by a casing 7 of an electronic device.

Covering the contact sections 3A of the contacts 3 by the shell 2 brings about a shielding effect against electromagnetic waves, while molding the housing 1 integrally with the shell 2 and the contacts 3 and molding the waterproof member 6 against the housing 1 result in preventing water from penetrating through the counter connector accommodating section 4 to the inside of the electronic device where the board 5 lies.

Since, however, the waterproof member 6 is molded against the housing 1 so as to cover the outer peripheral portion of the housing 1 and the board connecting sections 3B of the contacts 3, there is a problem in that the manufacture of the connector requires a lot of work.

Furthermore, in general, a metal material forming contacts and a shell and an insulating material such as resin forming a housing are different in thermal expansion coefficient from each other, and therefore, when, for example, a connector is exposed to a high temperature environment during a soldering process in mounting the connector onto a circuit board of an electronic device, due to the different degree of expansion between the metal material and the insulating material, the housing may be separated from surfaces of the contacts and the shell.

Aside from that, in a fitting process of a counter connector with the connector, when the counter connector is forcibly fitted in a direction oblique to the fitting axis, which is so-called "ill fitting," so that a high stress is applied between the housing and the contacts or the shell, the housing may be separated from surfaces of the contacts or the shell.

Once the housing is separated, a gap is formed between the insulating material forming the housing and the surfaces of the contacts and the shell, and water may enter the inside of the connector through the gap, which impairs waterproof properties of the connector even though the waterproof member 6 is molded against the housing 1.

SUMMARY OF THE INVENTION

The present invention has been made to eliminate the conventional drawback as above and is aimed at providing a thin waterproof connector that can reduce the influence of electromagnetic waves as well as improving waterproof properties and can still be easily manufactured.

A waterproof connector according to the present invention comprises:

one or more contacts;

a shell made of metal and covering outer peripheral portions of the one or more contacts;

a housing made of an insulating resin and holding the one or more contacts and the shell; and a waterproof member that is seamless and is disposed around a periphery of the housing, wherein the shell includes a fitted section that is exposed from the housing and is to be connected to a counter connector, a shell-side board connecting section that is exposed from the housing and is to be connected to a board, a shell-side fixed section that connects the fitted section and the shell-side board connecting section and is embedded in the housing, and a shell-side waterproof shaped section that is formed around a surface of the shell-side fixed section to block entry of water along an interface between the shell-side fixed section and the housing, wherein each of the one or more contacts includes a contact section that is exposed from the housing and is to be brought into contact with a contact of the counter connector, a contact-side board connecting section that is exposed from the housing and is to be connected to the board, a contact-side fixed section that connects the contact section and the contact-side board connecting section and is embedded in the housing, and a contact-side waterproof shaped section that is formed around a surface of the contact-side fixed section to block entry of water along an interface between the contact-side fixed section and the housing, wherein the fitted section has a pair of shell outer surfaces that are flat and face in opposite directions from each other, wherein the shell-side fixed section is positioned closer to a fitting axis between the waterproof connector and the counter connector than each of the pair of shell outer surfaces of the fitted section is when viewed in a direction of the fitting axis, and wherein the shell-side waterproof shaped section, the contact-side waterproof shaped section and the waterproof member are disposed to overlap each other at a position in the direction of the fitting axis.

DETAILED DESCRIPTION OF THE INVENTION

An embodiment of the present invention is described below based on the appended drawings.

Figure 1A:
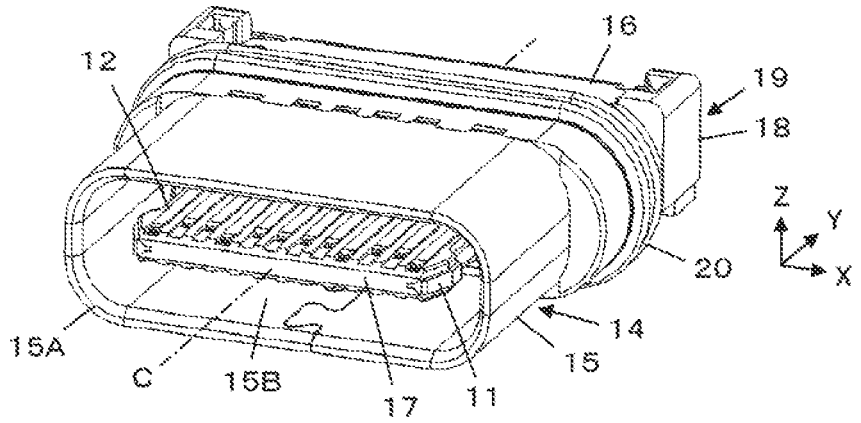
FIG. 1A to 1C show a connector according to an embodiment of the invention, FIG. 1A being a perspective view as seen from an obliquely upper front position, FIG. 1B being a perspective view as seen from an obliquely lower front position, FIG. 1C being a perspective view as seen from an obliquely upper rear position.
Figure 1B:
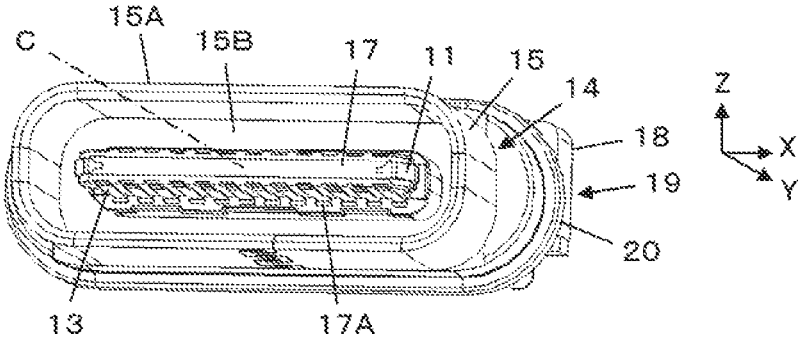
Figure 1C:
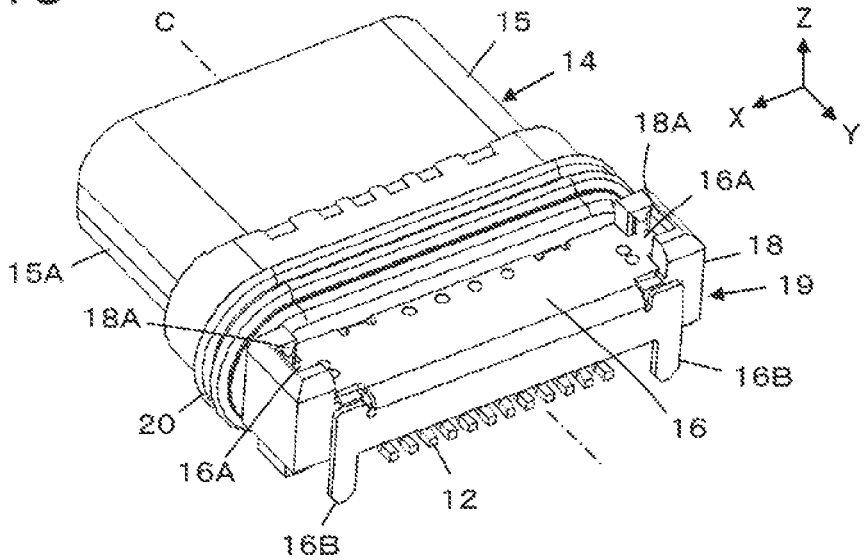

FIGS. 1A to 1C show a connector according to the embodiment. This connector is a receptacle connector to be fixed to a board in an electronic device such as a portable device or an information device, and includes: a mid-plate 11 made of metal and extending along a fitting axis C between the connector and a counter connector; and a plurality of first contacts 12 and a plurality of second contacts 13 that are separately arranged on both surfaces of the mid-plate 11 to face each other via the mid-plate 11. Each of the first contacts 12 and second contacts 13 extends parallel to the fitting axis C. A shell 14 made of metal is disposed to cover the outer peripheral portions of the first contacts 12 and second contacts 13.

For convenience, a direction from front to back of the connector along the fitting axis C is called "Y direction," an arrangement direction of the first contacts 12 and second contacts 13 "X direction," and a direction perpendicular to an XY plane and extending from the second contacts 13 to the first contacts 12 "Z direction."

The shell 14 includes a peripheral shell 15 covering outer peripheral portions of front portions, i.e., −Y directional portions of the first contacts 12 and second contacts 13, and a back shell 16 covering back portions of the first contacts 12 and second contacts 13 and connected to the peripheral shell 15. The peripheral shell 15 has a flat and cylindrical fitted section 15A whose size in the X direction is larger in length than the size in the Z direction and which takes the fitting axis C as the central axis. A counter connector accommodating section 15B to which a counter connector is inserted is formed in the fitted section 15A, and the front portions of the first contacts 12 and second contacts 13 project in the counter connector accommodating section 15B.

A first insulator 17 made of an insulating resin is molded integrally with the mid-plate 11, whereby the mid-plate 11 is held by the first insulator 17. The first contacts 12 and the second contacts 13 are separately press-fitted into a plurality of through-holes 17A formed in the first insulator 17 and extending parallel to the fitting axis C, and thereby held by the first insulator 17.

A second insulator 18 made of an insulating resin is molded integrally with rear portions, i.e., +Y directional portions of the peripheral shell 15, first contacts 12, second contacts 13 and first insulator 17, and a housing 19 is composed of the first insulator 17 and the second insulator 18.

A ring-shaped and seamless waterproof member 20 made of an elastic material such as rubber is disposed around the periphery of the second insulator 18.

The back shell 16 has a pair of fixing projections 16A formed to project in the opposite directions from each other along the X direction and is fixed to the +Y directional end of the second insulator 18 by press-fitting the fixing projections 16A to a pair of fixing grooves 18A formed in the second insulator 18 along the Z direction. A pair of shell-side board connecting sections 16B extending in the −Z direction are formed at the back shell 16.

Figure 2:
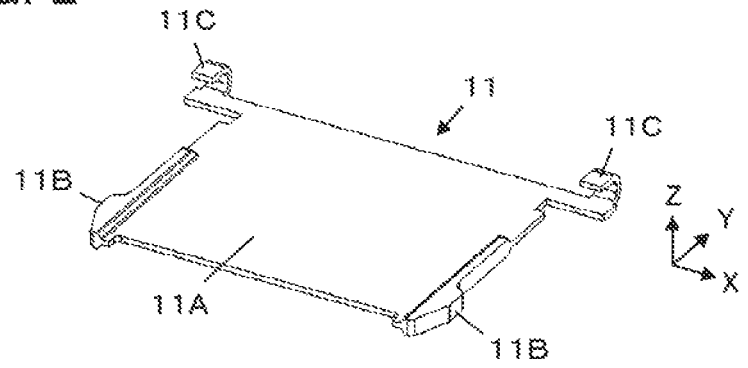
FIG. 2 is a perspective view showing a mid-plate used in the connector according to the embodiment.

As shown in FIG. 2, the mid-plate 11 has a flat plate section 11A extending along an XY plane. The flat plate section 11A is formed at its +X and −X directional ends at the −Y direction side with counter connector connecting sections 11B and at its +X and −X directional ends at the +Y direction side with ground plate connecting sections 11C projecting in the +Z direction.

Figure 3:
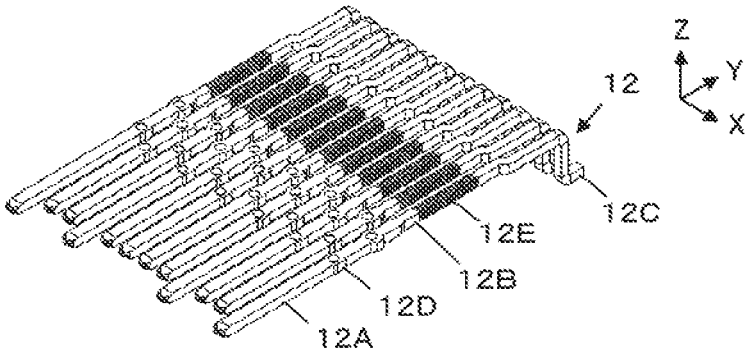
FIG. 3 is a perspective view showing a plurality of first contacts used in the connector according to the embodiment.

As shown in FIG. 3, the first contacts 12 are each composed of a plate-like member that has a first surface facing in the +Z direction and a second surface facing in the −Z direction and extends in the Y direction, and each have at its −Y directional end a contact section 12A exposed in the counter connector accommodating section 15B, at its middle portion a contact-side fixed section 12B embedded and fixed in the housing 19, and at its +Y directional end a contact-side board connecting section 12C to be connected to a board which is not shown. The first surface of the contact section 12A facing in the +Z direction is to come into contact with a contact of a counter connector inserted into the counter-connector accommodating section 15B. The contact section 12A and the contact-side fixed section 12B extend in the same XY plane to assume a flat plate shape. The contact-side board connecting section 12C connected to the contact-side fixed section 12B projects behind the housing 19 and is bent from the plane of the contact-side fixed section 12B to extend in the −Z direction.

Further, protrusions 12D for use in fixation to the through-holes 17A of the first insulator 17 are formed to protrude at a −Y direction-side portion of the contact-side fixed section 12B, and a contact-side waterproof shaped section 12E is formed around the surface of a +Y direction-side portion of the contact-side fixed section 12B to block the entry of water along the interface between the contact-side fixed section 12B and the housing 19.

Figure 4:
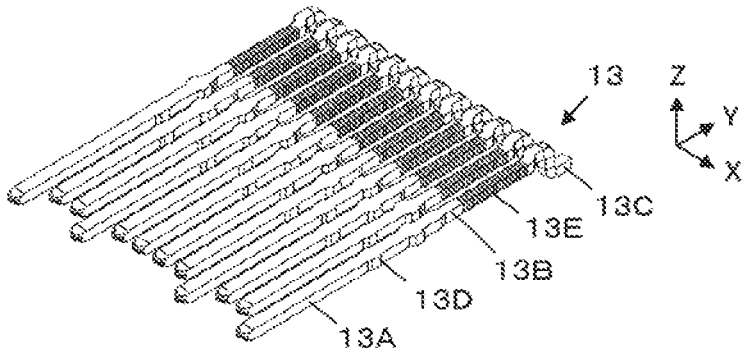
FIG. 4 is a perspective view showing a plurality of second contacts used in the connector according to the embodiment.

As shown in FIG. 4, the second contacts 13 are each composed of a plate-like member that has a first surface facing in the −Z direction and a second surface facing in the +Z direction and extends in the Y direction, and each have at its −Y directional end a contact section 13A exposed in the counter connector accommodating section 15B, at its middle portion a contact-side fixed section 13B embedded and fixed in the housing 19, and at its +Y directional end a contact-side board connecting section 13C to be connected to a board which is not shown. The first surface of the contact section 13A facing in the −Z direction is to come into contact with a contact of a counter connector inserted into the counter-connector accommodating section 15B. The contact section 13A and the contact-side fixed section 13B extend in the same XY plane to assume a flat plate shape. The contact-side board connecting section 13C connected to the contact-side fixed section 13B projects behind the housing 19 and is bent from the plane of the contact-side fixed section 13B to be exposed at the −Z direction side of the back shell 16.

Further, protrusions 13D for use in fixation to the through-holes 17A of the first insulator 17 are formed to protrude at a −Y direction-side portion of the contact-side fixed section 13B, and a contact-side waterproof shaped section 13E is formed around the surface of a +Y direction-side portion of the contact-side fixed section 13B to block the entry of water along the interface between the contact-side fixed section 13B and the housing 19.

Figure 5:
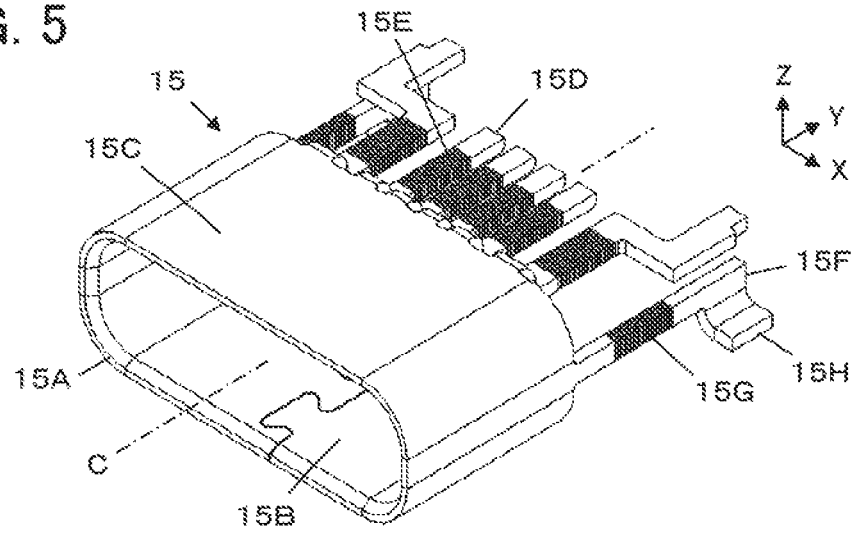
FIG. 5 is a perspective view showing a peripheral shell used in the connector according to the embodiment.

FIG. 5 shows the structure of the peripheral shell 15. The flat and cylindrical fitted section 15A has a pair of flat shell outer surfaces 15C each extending along an XY plane that face in the opposite directions from each other. Six first divisional fixed sections 15D are first bent from the +Y directional end of the fitted section 15A at the +Z direction side to extend in the −Z direction, and then extend in the +Y direction. By being first bent to extend in the −Z direction, each of the first divisional fixed sections 15D is positioned closer to the fitting axis C, i.e., to the −Z direction side, than the +Z direction-side shell outer surface 15C is when viewed in the direction of the fitting axis C, and a shell-side waterproof shaped section 15E is formed around the surface of a middle portion, in the Y direction, of each first divisional fixed section 15D.

In addition, two second divisional fixed sections 15F extend in the +Y direction from the +X and −X directional ends of the fitted section 15A. A shell-side waterproof shaped section 15G is formed around the surface of a middle portion, in the Y direction, of each second divisional fixed section 15F, and a shell-side board connecting section 15H projecting in the −Z direction is formed at the +Y directional end of each second divisional fixed section 15F.

Figure 6:
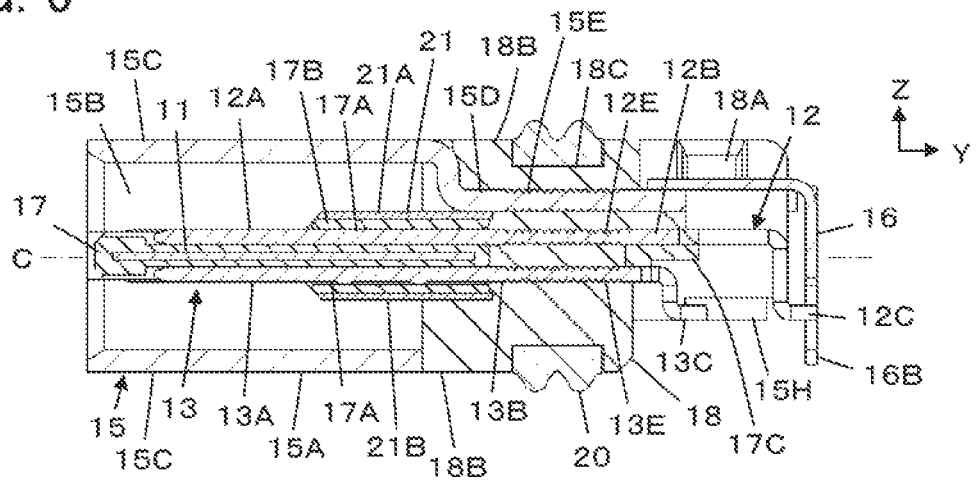
FIG. 6 is a sectional side view of the connector according to the embodiment cut along a YZ plane passing through one first contact, one second contact and one first divisional fixed section of the peripheral shell.

As shown in FIG. 6, the first insulator 17 has a mid-plate holding section 17B holding the mid-plate 11 and a rear holding section 17C positioned away from the mid-plate holding section 17B toward the +Y direction side. The −Y direction-side portions of the contact-side fixed sections 12B of the first contacts 12 and the −Y direction-side portions of the contact-side fixed sections 13B of the second contacts 13 are inserted into the corresponding through-holes 17A formed in the mid-plate holding section 17B, and the +Y directional ends of the contact-side fixed sections 12B adjacent to the contact-side board connecting sections 12C and the +Y directional ends of the contact-side fixed sections 13B adjacent to the contact-side board connecting sections 13C are in contact with the rear holding section 17C and held thereby.

The mid-plate 11 is disposed between the first contacts 12 and the second contacts 13 so as to be opposed to the second surfaces of the first contacts 12 facing in the −Z direction and the second surfaces of the second contacts 13 facing in the +Z direction.

The +Y direction-side portions of the contact-side fixed sections 12B, the +Y direction-side portions of the contact-side fixed sections 13B and the first divisional fixed sections 15D of the peripheral shell 15 are embedded in the second insulator 18. The contact-side waterproof shaped sections 12E formed around the surfaces of the contact-side fixed sections 12B, the contact-side waterproof shaped sections 13E formed around the surfaces of the contact-side fixed sections 13B and the shell-side waterproof shaped sections 15E formed around the surfaces of the first divisional fixed sections 15D are disposed to overlap one another at a position in the Y direction along the fitting axis C.

The second insulator 18 has a pair of flat housing outer surfaces 18B that extend along an XY plane and face in the opposite directions from each other. Those housing outer surfaces 18B form substantially the same planes with the corresponding shell outer surfaces 15C of the fitted section 15A of the peripheral shell 15.

An annular groove 18C for a waterproof member is formed around the periphery of the second insulator 18 so as to overlap the contact-side waterproof shaped sections 12E and 13E and the shell-side waterproof shaped sections 15E at a position in the Y direction, and the seamless waterproof member 20 is fitted in the groove 18C for a waterproof member. The bottom of the groove 18C for a waterproof member is positioned, in the Z direction, closer to the fitting axis C than the inner surface of the fitted section 15A of the peripheral shell 15 is when viewed in the direction of the fitting axis C. Owing to this configuration, even when the waterproof member 20 with a large thickness in the Z direction is disposed in the groove 18C for a waterproof member, the height of the connector in the Z direction at the position of the waterproof member 20 can be suppressed to a smaller height.

A ground plate 21 made of metal is disposed to cover the outer peripheral portions of the contact-side fixed sections 12B of the first contacts 12 and the contact-side fixed sections 13B of the second contacts 13 which are press-fitted to the through-holes 17A of the first insulator 17. The ground plate 21 has a flat section 21A that is opposed to the first surfaces, facing in the +Z direction, of the −Y direction-side portions of the contact-side fixed sections 12B of the first contacts 12 via the first insulator 17 and a flat section 21B that is opposed to the first surfaces, facing in the −Z direction, of the −Y direction-side portions of the contact-side fixed sections 13B of the second contacts 13 via the first insulator 17. The flat section 21A is connected to the first divisional fixed sections 15D of the peripheral shell 15.

Although not illustrated, a pair of ground plate connecting sections 11C of the mid-plate 11 are connected to the flat section 21A of the ground plate 21 so that the mid-plate 11 is connected to the peripheral shell 15 via the ground plate 21. The +Y directional ends of the first divisional fixed sections 15D of the peripheral shell 15 are exposed behind the second insulator 18 and connected to the back shell 16. Therefore, when the pair of shell-side board connecting sections 16B of the back shell 16 are connected to a board in an electronic device and brought to ground potential, the mid-plate 11, the ground plate 21, the peripheral shell 15 and the back shell 16 are to be all at ground potential accordingly.

Figure 7:
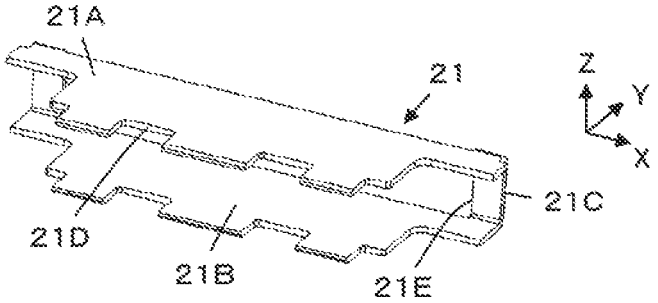
FIG. 7 is a perspective view showing a ground plate used in the connector according to the embodiment.

As shown in FIG. 7, the flat sections 21A and 21B of the ground plate 21 extend along an XY plane and are interconnected by a connecting section 21C in the Z direction. A plurality of cutouts 21D opening in the −Y direction are formed in each of the flat sections 21A and 21B, and an opening 21E is formed in the connecting section 21C to allow the first contacts 12 and the second contacts 13 to pass therethrough.

Figure 8:
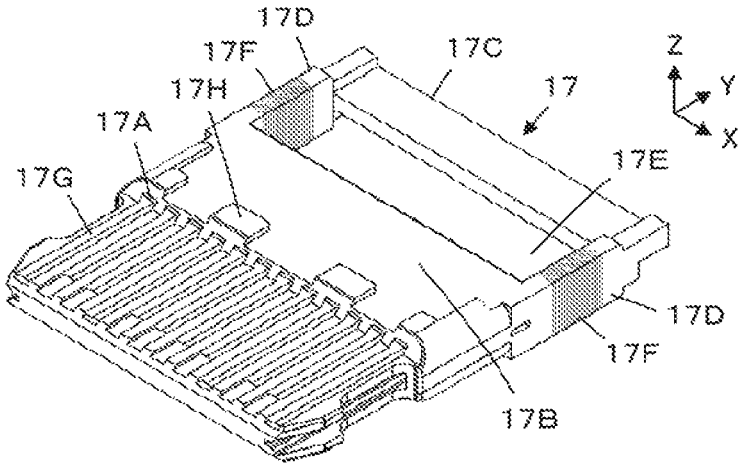
FIG. 8 is a perspective view showing a first insulator used in the connector according to the embodiment.

As shown in FIG. 8, the mid-plate holding section 17B of the first insulator 17 has a substantially flat plate shape extending along an XY plane, and the rear holding section 17C positioned away from the mid-plate holding section 17B in the +Y direction has a shape extending in the X direction. The +X and −X directional ends of the mid-plate holding section 17B are connected to the +X and −X directional ends of the rear holding section 17C through corresponding connecting sections 17D, respectively.

An opening 17E is formed so as to be surrounded by the mid-plate holding section 17B, the rear holding section 17C and the pair of connecting sections 17D, and housing-side waterproof shaped sections 17F are formed around the surfaces of the pair of connecting sections 17D.

Some of the through-holes 17A corresponding to the first contacts 12 and the others of the through-holes 17A corresponding to the second contacts 13 are arranged in two rows at a +Y direction-side portion of the mid-plate holding section 17B as spaced apart from each other in the Z direction. A plurality of grooves 17G for contacts to which the first contacts 12 and the second contacts 13 are inserted are formed at a −Y direction-side portion of the mid-plate holding section 17B at positions allowing connection with the corresponding through-holes 17A.

Convex sections 17H are formed to project at outer surfaces, facing in the +Z and −Z directions, of the +Y direction-side portion of the mid-plate holding section 17B so as to be separately fitted into the corresponding cutouts 21D of the ground plate 21.

Figure 9:
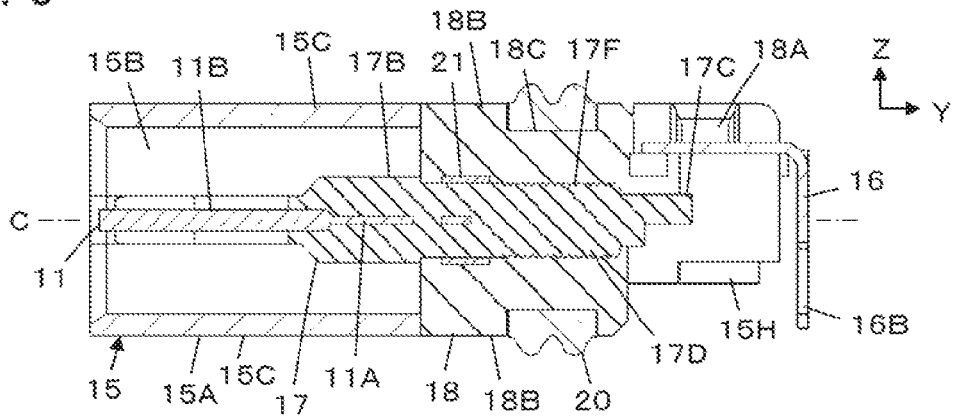
FIG. 9 is a sectional side view of the connector according to the embodiment cut along a YZ plane passing through one connecting section of the first insulator.

As shown in FIG. 9, each of the connecting sections 17D of the first insulator 17 is embedded in the second insulator 18, and each of the housing-side waterproof shaped sections 17F formed around the surfaces of the connecting sections 17D is disposed to overlap the waterproof member 20 at a position in the Y direction along the fitting axis C.

Figure 10:
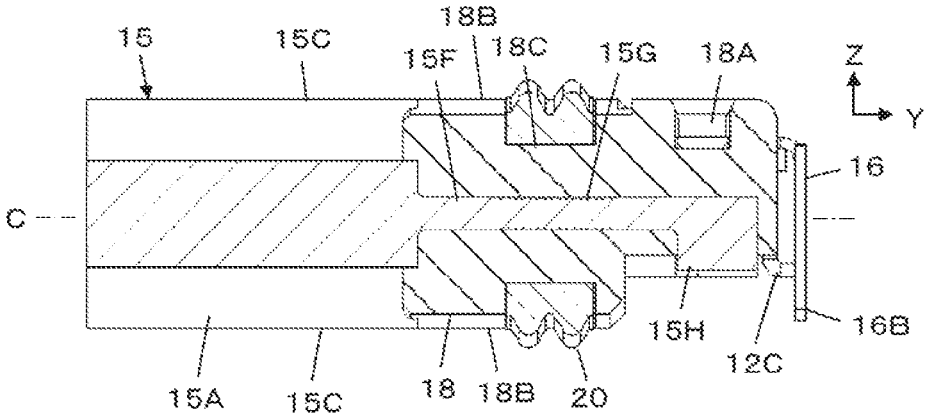
FIG. 10 is a sectional side view of the connector according to the embodiment cut along a YZ plane passing through one second divisional fixed section of the peripheral shell.

In addition, as shown in FIG. 10, each of the second divisional fixed sections 15F of the peripheral shell 15 is also embedded in the second insulator 18, and each of the shell-side waterproof shaped sections 15G formed around the surfaces of the second divisional fixed sections 15F is also disposed to overlap the waterproof member 20 at a position in the Y direction along the fitting axis C.

Figure 11:
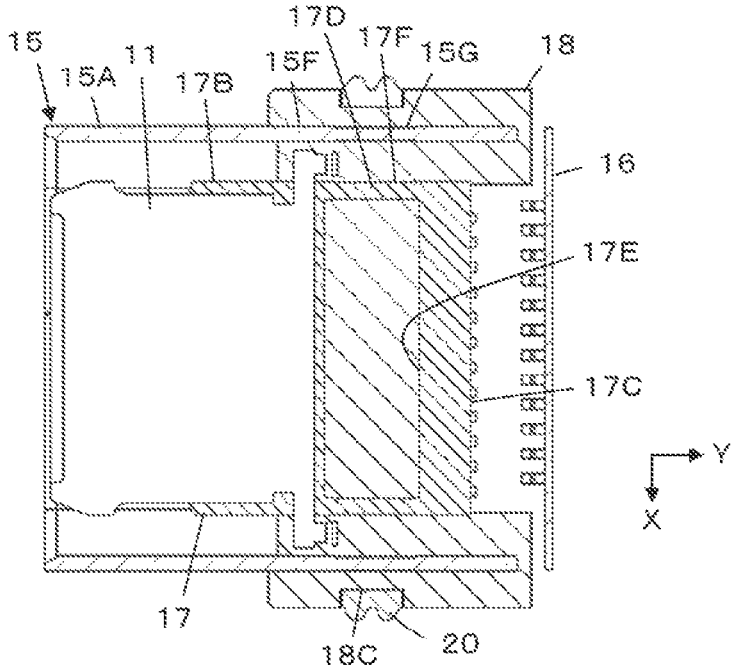
FIG. 11 is a sectional plan view of the connector according to the embodiment cut along an XY plane passing through the mid-plate.

As shown in FIG. 11, the opening 17E of the first insulator 17 is filled with the insulating resin forming the second insulator 18, and the contact-side waterproof shaped sections 12E of the first contacts 12 and the contact-side waterproof shaped sections 13E of the second contacts 13, which lie between the mid-plate holding section 17B and the rear holding section 17C of the first insulator 17, are embedded in the second insulator 18.

It can also be seen in FIG. 11 that the shell-side waterproof shaped sections 15G formed around the surfaces of the two second divisional fixed sections 15F of the peripheral shell 15 are embedded in the second insulator 18 so as to overlap the waterproof member 20 at a position in the Y direction.

Figure 12:
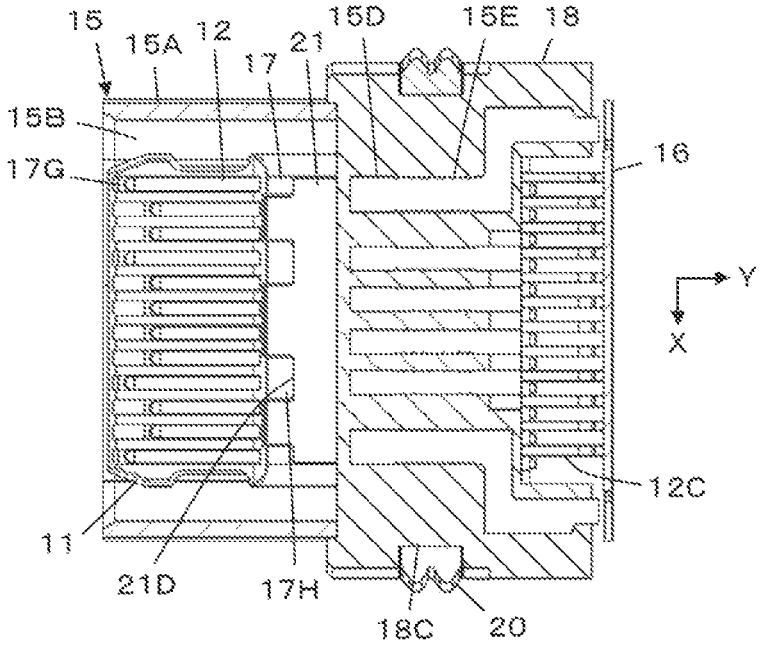
FIG. 12 is a sectional plan view of the connector according to the embodiment cut along an XY plane passing through one first divisional fixed section of the shell.

As shown in FIG. 12, the convex sections 17H of the first insulator 17 are fitted in the cutouts 21D of the ground plate 21, and the first contacts 12 are inserted in the corresponding grooves 17G for contacts.

It can also be seen in FIG. 12 that the shell-side waterproof shaped sections 15E formed around the surfaces of the six first divisional fixed sections 15D of the peripheral shell 15 are embedded in the second insulator 18 so as to overlap the waterproof member 20 at a position in the Y direction.

Figure 13:
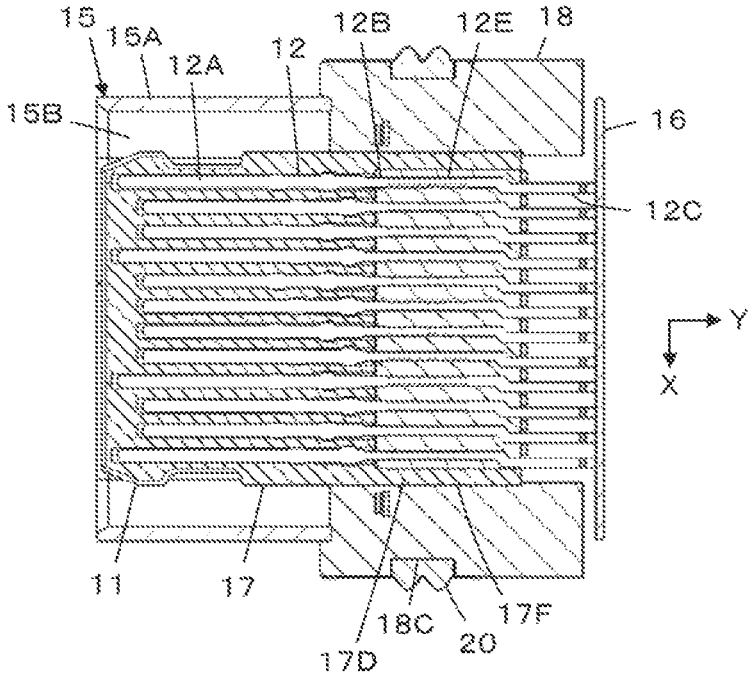
FIG. 13 is a sectional plan view of the connector according to the embodiment cut along an XY plane passing through one first contact.

Further, it can be seen in FIG. 13 that the contact-side waterproof shaped sections 12E formed around the surfaces of the contact-side fixed sections 12B of the first contacts 12 are embedded in the second insulator 18 so as to overlap the waterproof member 20 at a position in the Y direction. Similarly, it can be seen in FIG. 14 that the contact-side waterproof shaped sections 13E formed around the surfaces of the contact-side fixed sections 13B of the second contacts 13 are embedded in the second insulator 18 so as to overlap the waterproof member 20 at a position in the Y direction.

Figure 14:
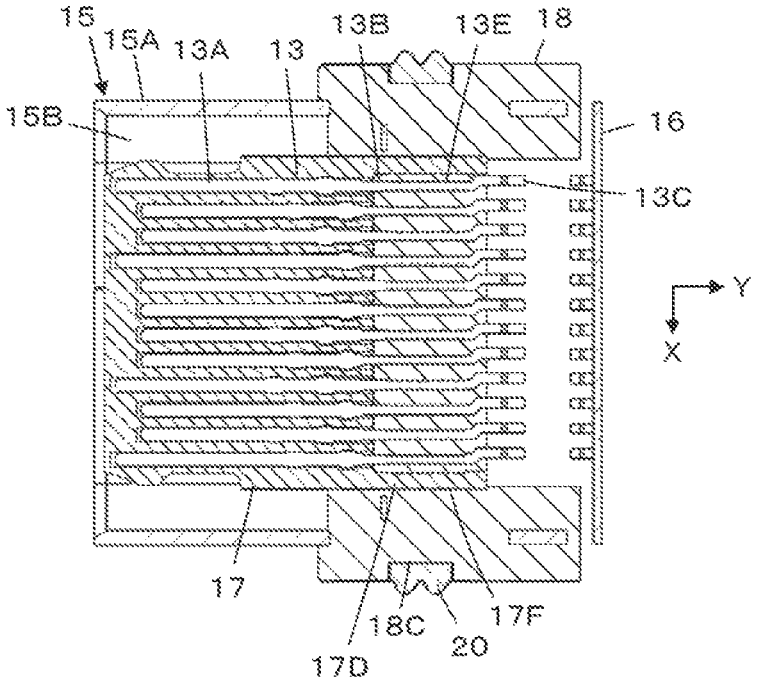
FIG. 14 is a sectional plan view of the connector according to the embodiment cut along an XY plane passing through one second contact.

It can also be seen in FIGS. 13 and 14 that the housing-side waterproof shaped sections 17F formed around the surfaces of the pair of connecting sections 17D of the first insulator 17 are embedded in the second insulator 18 so as to overlap the waterproof member 20 at a position in the Y direction.

The contact-side waterproof shaped sections 12E formed around the surfaces of the contact-side fixed sections 12B of the first contacts 12 are each composed of a plurality of grooves or protrusions surrounding and enclosing the periphery of the associated contact-side fixed section 12B, while the contact-side waterproof shaped sections 13E formed around the surfaces of the contact-side fixed sections 13B of the second contacts 13 are each composed of a plurality of grooves or protrusions surrounding and enclosing the periphery of the associated contact-side fixed section 13B.

Similarly, the shell-side waterproof shaped sections 15E formed around the surfaces of the first divisional fixed sections 15D of the peripheral shell 15 are each composed of a plurality of grooves or protrusions surrounding and enclosing the periphery of the associated first divisional fixed section 15D, while the shell-side waterproof shaped sections 15G formed around the surfaces of the second divisional fixed sections 15F are each composed of a plurality of grooves or protrusions surrounding and enclosing the periphery of the associated second divisional fixed section 15F.

The housing-side waterproof shaped sections 17F formed around the surfaces of the connecting sections 17D of the first insulator 17 are each composed of a plurality of grooves or protrusions surrounding and enclosing the periphery of the associated connecting section 17D.

The connector according to the embodiment can be manufactured by the following procedure.

First, by molding the first insulator 17 shown in FIG. 8 so that the mid-plate 11 is held with the mid-plate holding section 17B, a primary molded part in which the mid-plate 11 and the first insulator 17 are integral with each other is produced, and the first contacts 12 and the second contacts 13 shown in FIGS. 3 and 4 are press-fitted into the through-holes 17A formed in the first insulator 17 which is the primary molded part.

Figure 15:
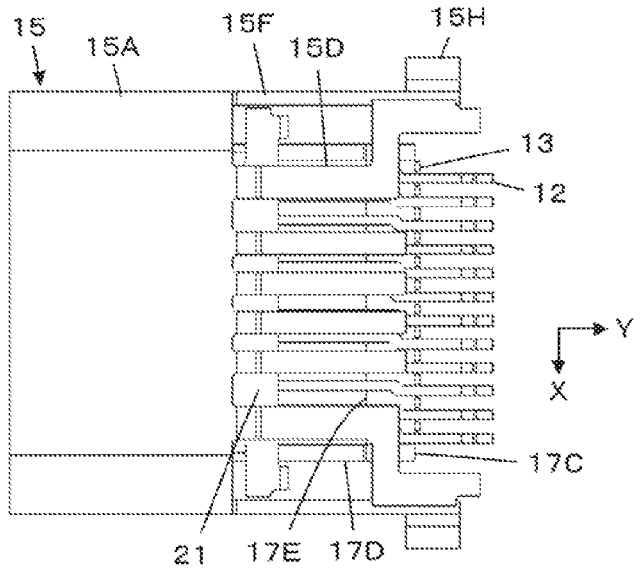
FIG. 15 is a plan view showing the connector according to the embodiment before a second insulator is molded.

Next, the ground plate 21 is aligned with the first insulator 17 which is the primary molded part as the first contacts 12 and the second contacts 13 are passed through the opening 21E of the ground plate 21. At the same time, with the ground plate 21 and the peripheral shell 15 being aligned with the primary molded part in a mold (not shown) as shown in FIG. 15, melt insulating resin is injected into the mold to form the second insulator 18.

At this time, the contact-side fixed sections 12B of the first contacts 12, the contact-side fixed sections 13B of the second contacts 13 and the six first divisional fixed sections 15D of the peripheral shell 15 are disposed to overlap each other at a position in the Y direction, and the opening 17E is formed in the first insulator 17 so as to correspond to the overlapping position, which allows the melt insulating resin to easily and properly flow in spaces between the foregoing parts.

As a result, the contact-side fixed sections 12B of the first contacts 12, the contact-side fixed sections 13B of the second contacts 13, the six first divisional fixed sections 15D and two second divisional fixed sections 15F of the peripheral shell 15, and the pair of connecting sections 17D of the first insulator 17 are embedded in the second insulator 18. In addition, the insulating resin forming the second insulator 18 tightly adheres to the contact-side waterproof shaped sections 12E of the first contacts 12, the contact-side waterproof shaped sections 13E of the second contacts 13, the shell-side waterproof shaped sections 15E and 15G of the peripheral shell 15, and the housing-side waterproof shaped sections 17F of the first insulator 17.

Figure 16:
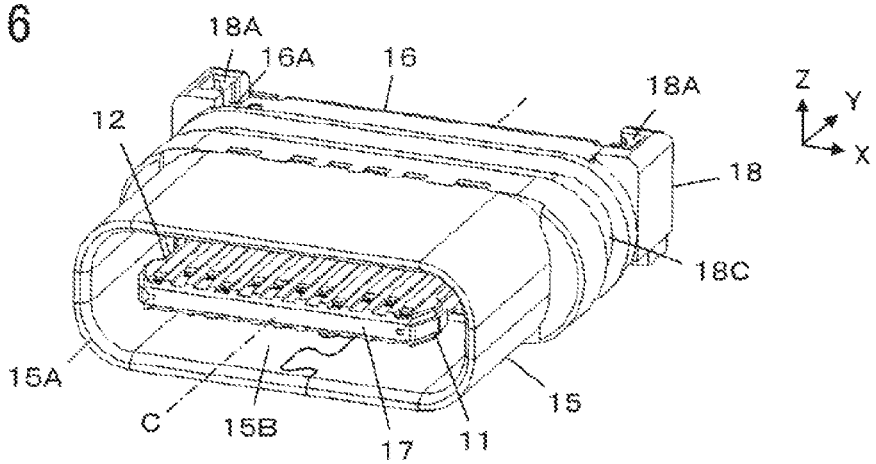
FIG. 16 is a perspective view showing the connector according to the embodiment with a waterproof member being removed.
Figure 17:
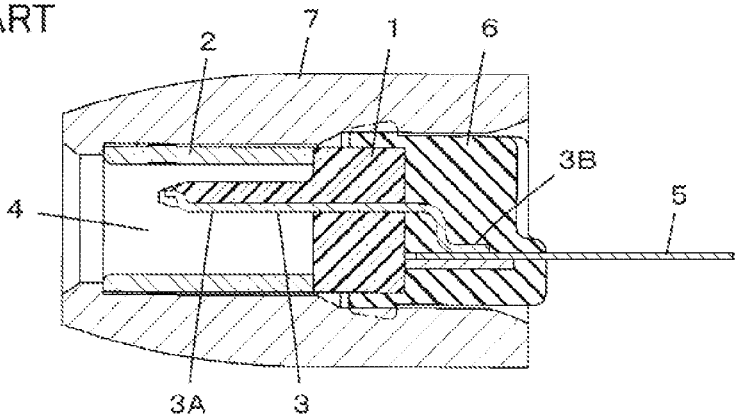
FIG. 17 PRIOR ART
FIG. 17 is a sectional side view of a conventional connector.

Further, as shown in FIG. 16, the back shell 16 is attached to the second insulator 18 by press-fitting the pair of fixing projections 16A of the back shell 16 into the pair of fixing grooves 18A of the second insulator 18, and then the back shell 16 is welded by, for instance, laser light to the +Y directional ends of the first divisional fixed sections 15D of the peripheral shell 15 that are exposed behind the second insulator 18. Finally, by fitting the seamless waterproof member 20 into the groove 18C for a waterproof member as formed around the periphery of the second insulator 18, the connector is manufactured.

The connector is used with the contact-side board connecting sections 12C of the first contacts 12, the contact-side board connecting sections 13C of the second contacts 13, the shell-side board connecting sections 15H of the peripheral shell 15, and the shell-side board connecting sections 16B of the back shell 16 being connected to the corresponding connection pads on a board in an electronic device (not shown) by, for example, soldering, and the fitting axis C extending in parallel to the surface of the board.

The contact-side waterproof shaped sections 12E and 13E are formed at the contact-side fixed sections 12B of the first contacts 12 and the contact-side fixed sections 13B of the second contacts 13 as embedded in the second insulator 18. Therefore, even if the insulating resin of the second insulator 18 tightly adhering to the surfaces of the contact-side fixed sections 12B of the first contacts 12 and the contact-side fixed sections 13B of the second contacts 13 is separated from the surfaces, and water penetrates along the contact sections 12A of the first contacts 12 and the contact sections 13A of the second contacts 13 as exposed in the counter connector accommodating section 15B and further along the interface between the contact-side fixed sections 12B and 13B and the second insulator 18, the penetrating water is blocked by the contact-side waterproof shaped sections 12E and 13E and prevented from reaching the contact-side board connecting sections 12C and 13C exposed behind the second insulator 18.

Similarly, the shell-side waterproof shaped sections 15E and 15G are formed at the first and second divisional fixed sections 15D and 15F of the peripheral shell 15 as embedded in the second insulator 18. Therefore, even if the insulating resin of the second insulator 18 tightly adhering to the surfaces of the first and second divisional fixed sections 15D and 15F of the peripheral shell 15 is separated from the surfaces, and water penetrates from the fitted section 15A exposed in the counter connector accommodating section 15B and along the interface between the first and second divisional fixed sections 15D and 15F and the second insulator 18, the penetrating water is blocked by the shell-side waterproof shaped sections 15E and 15G and prevented from reaching the back of the second insulator 18.

In addition, since the housing-side waterproof shaped sections 17F are formed at the connecting sections 17D of the first insulator 17 as embedded in the second insulator 18, even if water penetrates along the surface of the first insulator 17 exposed in the counter connector accommodating section 15B, the penetrating water is blocked by the housing-side waterproof shaped sections 17F.

Furthermore, the contact-side waterproof shaped sections 12E and 13E, the shell-side waterproof shaped sections 15E and 15G and the housing-side waterproof shaped sections 17F are disposed to overlap each other in a position in the Y direction along the fitting axis C, and the seamless waterproof member 20 is disposed around the periphery of the second insulator 18 so as to correspond to the overlapping position. Therefore, when the connector is mounted on an electronic device with the waterproof member 20 being compressed by, for instance, a casing of the electronic device, the compression acting on the waterproof member 20 is further exerted on the contact-side waterproof shaped sections 12E and 13E, the shell-side waterproof shaped sections 15E and 15G and the housing-side waterproof shaped sections 17F via the second insulator 18, which enhances the adhesion between those waterproof shaped sections and the second insulator 18, thereby improving a waterproof effect.

Thus, the waterproof properties are improved between the second insulator 18 of the housing 19 and the first contacts 12, the second contacts 13, the peripheral shell 15 and the first insulator 17, so that water can be prevented from penetrating to the interior of a device, i.e., to the side at which a board having mounted thereon the waterproof connector is placed.

When the shell-side board connecting sections 15H of the peripheral shell 15 and the shell-side board connecting sections 16B of the back shell 16 are separately connected to the corresponding connection pads on a board in an electronic device (not shown) and brought to ground potential, the mid-plate 11, the ground plate 21, the peripheral shell 15 and the back shell 16 are to be all at ground potential accordingly, which makes it possible to carry out highly reliable signal transmission while reducing the influence of electromagnetic waves.

Furthermore, the pair of flat housing outer surfaces 18B of the second insulator 18 each form substantially the same plane with the corresponding flat shell outer surface 15C of the fitted section 15A of the peripheral shell 15, and the bottom of the groove 18C for a waterproof member as formed around the periphery of the second insulator 18 is positioned closer to the fitting axis C than the inner surface of the fitted section 15A of the peripheral shell 15 is when viewed in the direction of the fitting axis C. Owing to this, the height of the connector in the Z direction is suppressed, which makes it possible to obtain a thin connector.

While in the embodiment, as shown in FIGS. 1A to 1C, the connector is configured so that the +X and −X directional ends of the second insulator 18 project further outward than the +X and −X directional ends of the fitted section 15A of the peripheral shell 15, respectively, the width of the second insulator 18 in the X direction can be made equal to the width of the fitted section 15A of the peripheral shell 15 in the X direction by additionally bending the pair of second divisional fixed sections 15F of the peripheral shell 15 toward the fitting axis C, thus obtaining a smaller connector with a smaller width in the X direction. In this case, the entire bottom of the groove 18C for a waterproof member as formed around the periphery of the second insulator 18 is preferably positioned closer to the fitting axis C than the inner surface of the fitted section 15A of the peripheral shell 15 is when viewed in the direction of the fitting axis C.

In the foregoing embodiment, the contact-side waterproof shaped sections 12E are each composed of a plurality of grooves or protrusions surrounding and enclosing the periphery of the associated contact-side fixed section 12B, the contact-side waterproof shaped sections 13E are each composed of a plurality of grooves or protrusions surrounding and enclosing the periphery of the associated contact-side fixed section 13B, the shell-side waterproof shaped sections 15E are each composed of a plurality of grooves or protrusions surrounding and enclosing the periphery of the associated first divisional fixed section 15D, the shell-side waterproof shaped sections 15G are each composed of a plurality of grooves or protrusions surrounding and enclosing the periphery of the associated second divisional fixed section 15F, and the housing-side waterproof shaped sections 17F are each composed of a plurality of grooves or protrusions surrounding and enclosing the periphery of the associated connecting section 17D; however, each of those grooves or protrusions is not necessarily formed to surround and enclose the periphery but may be formed merely at one section along the periphery for achieving a waterproof effect. Nevertheless, grooves or protrusions formed to surround and enclose the periphery lead to more excellent waterproof function.

While each of the contact-side waterproof shaped sections 12E and 13E, the shell-side waterproof shaped sections 15E and 15G and the housing-side waterproof shaped sections 17F is composed of a plurality of grooves or protrusions, a single groove or protrusion can still minimize the entry of water along the interface between the relevant surface and the second insulator 18. However, a plurality of grooves or protrusions lead to a more excellent waterproof effect.

To minimize the entry of water along the interface between the relevant surface and the second insulator 18, it is preferable for a groove or protrusion to have a height difference of, for instance, not less than 0.01 mm.

While in the foregoing embodiment, the first contacts 12 and the second contacts 13 are arranged in two rows separately on both surfaces of the mid-plate 11 to face each other, the invention is not limited thereto and may be applied to a connector in which a plurality of contacts are arranged in a single row.

The number of contacts is not limited, and it suffices if one or more contacts are held by a housing.

REFERENCE SIGNS LIST

1 housing; 2 shell; 3 contact; 3A contact section; 3B board connecting section; 4 counter connector accommodating section; 5 board; 6 waterproof member; 7 casing; 11 mid-plate; 11A flat plate section; 11B counter connector connecting section; 11C ground plate connecting section; 12 first contact; 12A, 13A contact section; 12B, 13B contact-side fixed section; 12C, 13C contact-side board connecting section; 12D, 13D protrusion; 12E, 13E contact-side waterproof shaped section; 13 second contact; 14 shell; 15 peripheral shell; 15A fitted section; 15B counter connector accommodating section; 15C shell outer surface; 15D first divisional fixed section; 15E, 15G shell-side waterproof shaped section; 15F second divisional fixed section; 15H shell-side board connecting section; 16 back shell; 16A fixing projection; 16B shell-side board connecting section; 17 first insulator; 17A through-hole; 17B mid-plate holding section; 17C rear holding section; 17D connecting section; 17E opening; 17F housing-side waterproof shaped section; 17G groove for a contact; 17H convex section; 18 second insulator; 18A fixing groove; 18B housing outer surface; 18C groove for a waterproof member; 19 housing; 20 waterproof member; 21 ground plate; 21A, 21B flat section; 21C connecting section; 21D cutout; 21E opening; C fitting axis.

What is claimed is:

1. A waterproof connector comprising:

one or more contacts;

a shell made of metal and covering outer peripheral portions of the one or more contacts;

a housing made of an insulating resin and holding the one or more contacts and the shell; and a waterproof member that is seamless and is disposed around a periphery of the housing, wherein the shell includes a fitted section that is exposed from the housing and is to be connected to a counter connector, a shell-side board connecting section that is exposed from the housing and is to be connected to a board, a shell-side fixed section that connects the fitted section and the shell-side board connecting section and is embedded in the housing, and a shell-side waterproof shaped section that is formed around a surface of the shell-side fixed section to block entry of water along an interface between the shell-side fixed section and the housing, wherein each of the one or more contacts includes a contact section that is exposed from the housing and is to be brought into contact with a contact of the counter connector, a contact-side board connecting section that is exposed from the housing and is to be connected to the board, a contact-side fixed section that connects the contact section and the contact-side board connecting section and is embedded in the housing, and a contact-side waterproof shaped section that is formed around a surface of the contact-side fixed section to block entry of water along an interface between the contact-side fixed section and the housing, wherein the fitted section has a pair of shell outer surfaces that are flat and face in opposite directions from each other, wherein the shell-side fixed section is positioned closer to a fitting axis between the waterproof connector and the counter connector than each of the pair of shell outer surfaces of the fitted section is when viewed in a direction of the fitting axis, and wherein the shell-side waterproof shaped section, the contact-side waterproof shaped section and the waterproof member are disposed to overlap each other at a position in the direction of the fitting axis.

2. The waterproof connector according to claim 1, wherein the fitting axis extends in parallel to a surface of the board, and wherein the shell-side fixed section is positioned across the contact-side fixed section from the board.

3. The waterproof connector according to claim 2, wherein the shell-side fixed section is composed of a plurality of divisional fixed sections each of which connects the fitted section and the shell-side board connecting section and which are embedded in the housing, and wherein the shell-side waterproof shaped section is formed around a surface of each of the plurality of divisional fixed sections.

4. The waterproof connector according to claim 2, wherein the housing has a pair of housing outer surfaces which are flat, each of which forms substantially same plane with a corresponding one of the pair of shell outer surfaces, and at which the waterproof member is disposed.

5. The waterproof connector according to claim 4, wherein the waterproof member is fitted in a groove for a waterproof member that is annular and that is formed around the periphery of the housing.

6. The waterproof connector according to claim 5, wherein a bottom of the groove for a waterproof member as formed in the pair of housing outer surfaces is positioned closer to the fitting axis than an inner surface of the fitted section is when viewed in the direction of the fitting axis.

7. The waterproof connector according to claim 6, wherein the entire bottom of the groove for a waterproof member that is annular is positioned closer to the fitting axis than the inner surface of the fitted section is when viewed in the direction of the fitting axis.

8. The waterproof connector according to claim 1, wherein the one or more contacts are each composed of a plate-like member having a first surface and a second surface that face in opposite directions from each other, and wherein the contact section is formed on the first surface, the waterproof connector including a mid-plate that is made of metal and is disposed to face the second surface in vicinity of the contact section.

9. The waterproof connector according to claim 8, including a ground plate that is made of metal, disposed to face the first surface in vicinity of the contact section, and connected to the mid-plate and the shell.

10. The waterproof connector according to claim 8, wherein the one or more contacts comprise a plurality of first contacts and a plurality of second contacts that are separately arranged on both surfaces of the mid-plate to face each other via the mid-plate.

11. The waterproof connector according to claim 8, wherein the housing includes:

a first insulator holding the mid-plate and having formed therein a through-hole in which a front portion of the contact-side fixed section adjacent to the contact section is press-fitted with the contact-side waterproof shaped section remaining exposed; and a second insulator covering the shell-side waterproof shaped section and the contact-side waterproof shaped section and holding the shell-side fixed section and the first insulator.

12. The waterproof connector according to claim 11, wherein the first insulator includes:

a mid-plate holding section holding the mid-plate and having formed therein the through-hole;

a rear holding section that is in contact with a rear portion of the contact-side fixed section adjacent to the contact-side board connecting section; and a connecting section extending in the direction of the fitting axis and connecting the mid-plate holding section and the rear holding section, wherein the contact-side waterproof shaped section is positioned between the mid-plate holding section and the rear holding section.

13. The waterproof connector according to claim 12, wherein the connecting section of the first insulator is covered by the second insulator, and wherein a housing-side waterproof shaped section for blocking entry of water along an interface between the connecting section of the first insulator and the second insulator is formed around a surface of the connecting section.

14. The waterproof connector according to claim 1, wherein the shell includes:

a peripheral shell having the fitted section and the shell-side fixed section; and a back shell that covers the contact-side board connecting section exposed from a back of the housing in the direction of the fitting axis and is connected to the peripheral shell.

* * * * *